United States Patent [19]

Werners et al.

[11] Patent Number: 4,552,339

[45] Date of Patent: Nov. 12, 1985

[54] HOISTING DEVICE WITH COMPENSATED TACKLE

[75] Inventors: Theo F. H. Werners, Bilthoven; Berend W. Drenth, Drunen, both of Netherlands

[73] Assignee: Hydraudyne B.V., Boxtel, Netherlands

[21] Appl. No.: 617,387

[22] Filed: Jun. 5, 1984

[30] Foreign Application Priority Data

Jun. 6, 1983 [NL] Netherlands ..... 8302006

[51] Int. Cl.[4] ..... B66D 1/50

[52] U.S. Cl. ..... 254/277; 254/335; 254/337; 254/392

[58] Field of Search ..... 254/392, 277, 413, 335, 254/337

[56] References Cited

U.S. PATENT DOCUMENTS

| | | | |
|---|---|---|---|
| 3,151,686 | 10/1964 | Kammerer . | |
| 3,743,249 | 7/1973 | Van Daalen | 254/277 X |
| 3,749,367 | 7/1973 | Joubert et al. . | |
| 3,912,227 | 10/1975 | Meeker et al. | 254/277 X |
| 4,076,218 | 2/1978 | Gault | 254/326 |
| 4,236,695 | 12/1980 | Morrison | 254/277 |
| 4,291,474 | 9/1981 | Schmidt | 37/67 |
| 4,341,373 | 7/1982 | Mouton, Jr. | 254/386 |

FOREIGN PATENT DOCUMENTS

| | | |
|---|---|---|
| 2169379 | 9/1973 | France . |
| 2308738 | 11/1976 | France . |
| 2355765 | 1/1978 | France . |
| 2418193 | 9/1979 | France . |

*Primary Examiner*—Stuart S. Levy
*Assistant Examiner*—Katherine Jaekel
*Attorney, Agent, or Firm*—John P. Snyder

[57] ABSTRACT

A hydraulic or pneumatic cylinder supports a pair of non-circular discs and a circular pulley about which a hoisting cable and a carrying cable are trained. The discs are configured such that a constant force is exerted on a load supported by the hoisting cable independent of the variation in pressure in the cylinder due to displacement of the piston supporting the discs. The carrying cable comprises two runs; one having one end fixed to one of the discs and the other end fixed to the supporting base, and the other having one end fixed to the other disc and the other end fixed to a pulley block supporting the load. The hoisting cable extends from a winch, over the circular pulley, to the pulley block. The arrangement compensates for relative motion between the load and the supporting base.

14 Claims, 6 Drawing Figures

Figure 5:
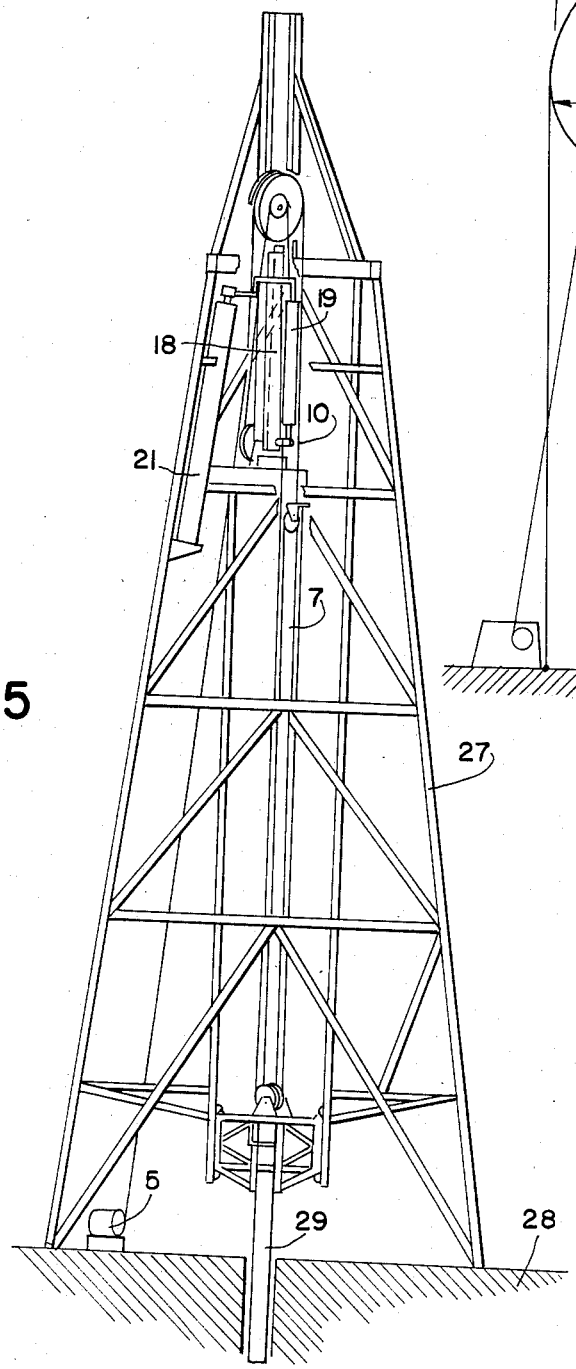

FIG. 1
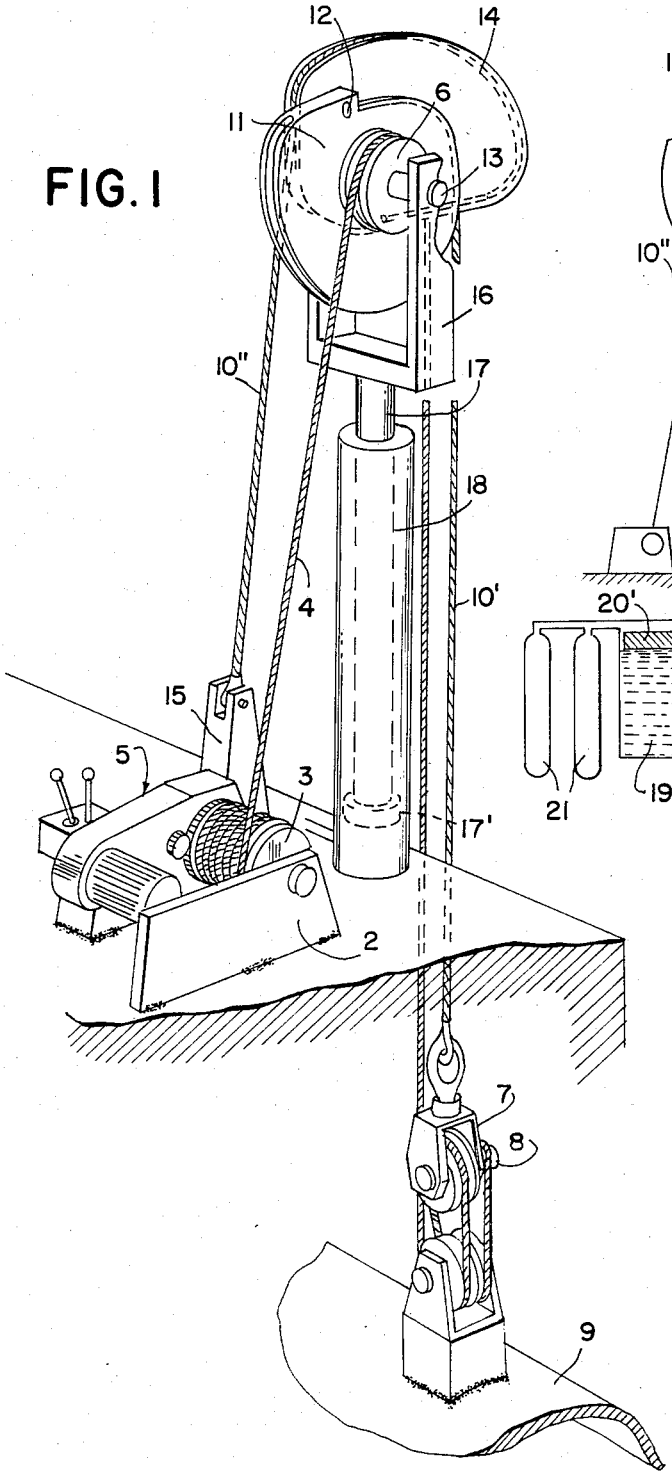
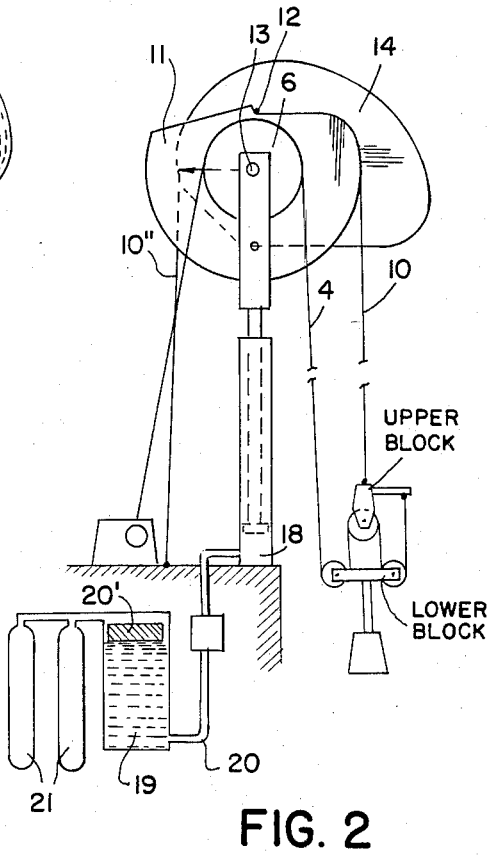
FIG. 2

FIG. 4
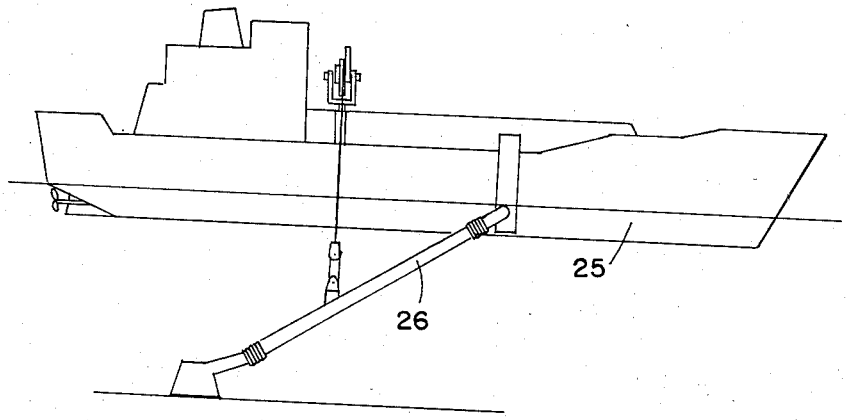
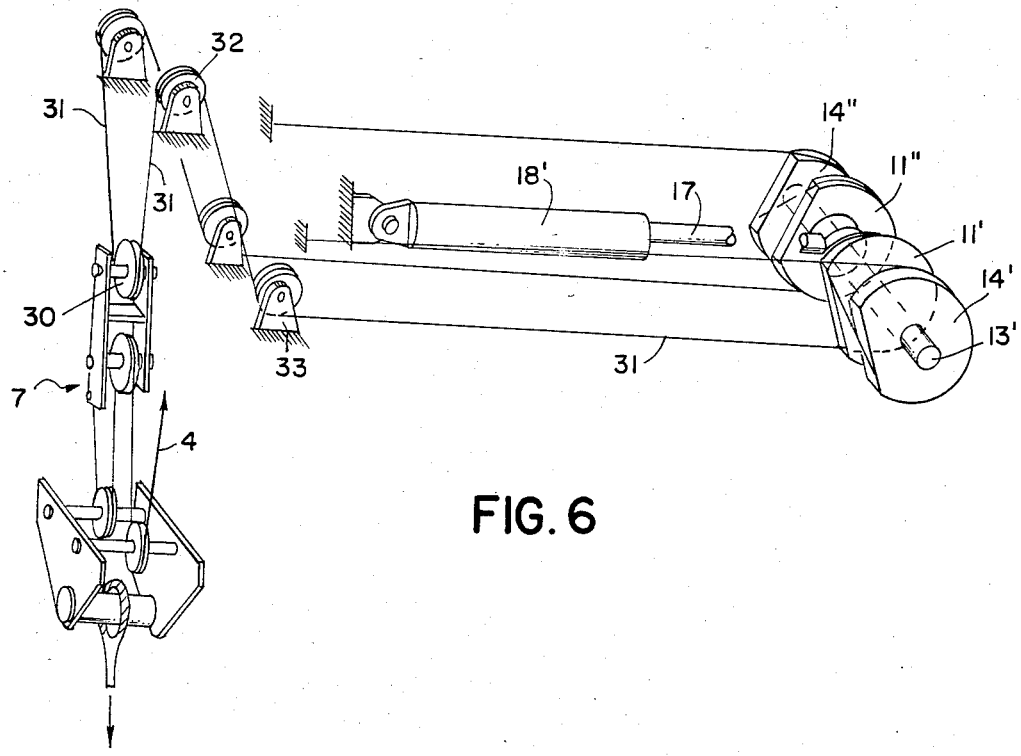
FIG. 6

HOISTING DEVICE WITH COMPENSATED TACKLE

The invention relates to a hoisting device disposed on a freely movable support and mainly comprising one or more hoisting cables adapted to be wound on a winch drum or the like connected with said support and leading to a freely hanging tackle which carries the load.

The invention has for its object to construct the hoisting device so that despite the freely movable support the lower block of the tackle and hence the load remain hanging at the same level.

The device embodying the invention is distinguished in that the tackle is suspended to at least one carrying cable which is directly or indirectly fastened to the support via a disc displaceable by a setting member with respect to the support.

Thanks to the setting member it is now possible to move the tackle with respect to the displaceable support without the need for paying off or hauling the hoisting cable. The setting member takes care of the desired displacement of the disc which thus compensates for the movement of the support. If the load is an element bearing on the sea bottom, a constant ground pressure can thus be maintained.

In a preferred embodiment the setting member is formed by a hydraulic or pneumatic cylinder controlled by a gas buffer.

In order to enable a compensation of the gas pressure fluctuations in the gas buffer, the displaceable disc is designed in the form of a cam or eccentric disc so that with a possibly constant load force automatic compensation occurs as a function of the displacement of the piston rod in the cylinder.

In a further embodiment a reversing disc can, in addition, be journalled for the hoisting cable on the rotary shaft of the displaceable disc so that the hoisting cable need not be hauled or payed out.

The invention will be described more fully with reference to a few embodiments.

The drawing shows in

Figure 3:
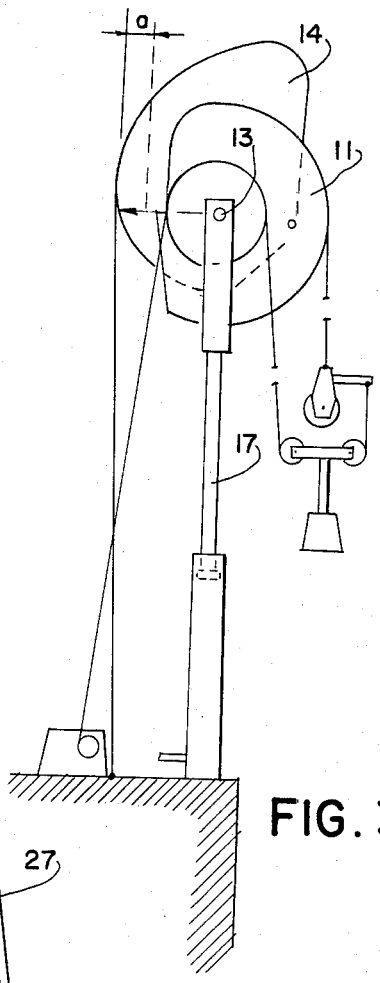

FIG. 1 a perspective view of a first embodiment of the hoisting device,

FIGS. 2 and 3 schematic side elevations of the hoisting device of FIG. 1 in two different working positions, FIG. 4 a schematic elevational view of a potential use on a vessel, FIG. 5 a second potential use in a drilling derrick arranged, for example, on the vessel of FIG. 4, FIG. 6 a schematic, perspective view of an alternative embodiment of the hoisting device.

The hoisting device shown in FIG. 1 is arranged on a freely movable support 1, which may be a vehicle or a vessel.

The hoisting device mainly comprises a winch 2 provided with a winch drum 3, about which a hoisting cable 4 can be wound. The winch drum can be rotated by any driving gear 5.

The hoisting cable 4 leads via a reversing disc 6 to a tackle 7, which consists in this embodiment of a one-disc upper block and a double-disc lower block. The end of the hoisting cable is fastened at 8 to the upper block. The lower block carries a load 9 and may be constructed in any manner with a magnet shoe, hoisting eyelet or the like.

The upper block of the tackle 7 is suspended to a carrying cable 10, the first run of which leads to a segment disc 11. This first run 10' is guided in a circumferential groove and fastened at 12. The segment disc 11 is fastened to a rotary shaft 13, on which is journalled the reversing top disc 6 of the hoisting cable 4.

At the side of the segment disc 11 is arranged a second segment disc 14, which cannot rotate with respect to the segment disc 11. The second run of the carrying cable 10 is fastened to the circumference thereof and also guided through a circumferential groove, said second run passing to a fixed point 15 of the support 1.

The rotary shaft 13 is journalled in a fork-like support 16, which is arranged at the top side of a piston rod 17. The piston rod 17 is part of a hydraulic cylinder 18, which is rigidly secured to the support 1. The hydraulic cylinder 18 enables the upward and downward movements of the rotary shaft 13 and hence of the top disc 6 and the two segment discs 11 and 14.

The device described above operates in general as follows. During a downward movement of the support 1, for example, due to swell in the case of a vessel, the tackle 7 can be held at its level with respect to the sea bottom by energizing the cylinder 18 so that the piston rod 17 moves out of the cylinder 18. Thus the hoisting cable 4 as well as the carrying cable is moved along the discs so that the segment discs 11 and 14 respectively will turn around the shaft 13. Also the top disc 6 will turn, but with a circumferential speed differing from that of the segment discs.

When due to pressure fluctuations in the energizing medium of the cylinder 18 the setting force varies in dependence on the displacement of the piston 17' in the cylinder, the circumferential shape of the segment discs 11 and 13 can be adapted thereto in a manner such that the reactive pressure resulting from the load on the piston rod 17 also varies in relationship to the setting pressure in the cylinder 18 so that compensation is obtained.

The foregoing is set out in detail in FIGS. 2 and 3. The same parts are designated by the same reference numerals and it is assumed that a gas buffer controlled cylinder 18 is used. The cylinder itself is a hydraulic cylinder fed by a fluid stored in a reservoir 19, which communicates through the feed duct 20 with the lower side of the cylinder 18. The reservoir 19 is provided with a separation piston 20, on the other side of which a pressurized gas is operative. This pressurized gas is stored in bottles 21. When the piston rod 17 has to move upwards in the cylinder 18, fluid is pressed from the reservoir 19 below the piston 17' by means of the gas pressure in the bottles 21. Obviously with an increasing gas volume the gas pressure decreases and hence also the force expelling the piston rod 17. This can be compensated for by varying the reactive torque produced by the run 10'' so that a constant force on the lower block of the tackle is ensured.

FIG. 3 illustrates how this is achieved in the embodiment concerned. The segment disc 11 has a circumferential groove, which is in this embodiment concentric with the rotary shaft 13. The second segment disc 14, however, is designed so that, when the piston 17' moves outwards, the distance between the second run 10'' and the rotary shaft 13 varies. This distance variation is indicated by "a" in FIG. 3. Since the tractive forces in the runs 4 and 10' will be substantially constant, a reactive torque depending on the position of the piston rod 17 will occur as a result of the variation of the radius with respect to the rotary shaft 13. Since this reactive torque varies in proportion to the decrease and increase of the gas pressure in the bottles 21, a constant force is maintained on the lower block of the tackle.

It will be obvious that any other shape of the two segment discs 11 and 14 is possible, whilst it is also possible to use only one cam disc, that is to say, a combination of the segment discs 11, 14 in which the carrying cable directly passes on and the friction between cable and disc ensures the "connection".

FIGS. 4 and 5 show two possibilities of use, in which a vessel 25 is provided with an implement 26 on the underside thereof. The end of the implement 26 may serve for working the bottom, to scan it and the like and it will be obvious that the end of the implement 26 has to remain at the correct level and the gas pressure has to be constant and low. The implement 26 is suspended to the hoisting appliance described with reference to FIGS. 1 to 3 on the deck of the vessel 25 so that in the case of swell the upward and downward movements of the ship's hull, i.e. the support 1 in FIG. 1, are compensated for.

In the second example of use a drilling derrick is mounted on, for example, a floating working platform 28 so that also in this case in the event of swell the lower tackle block to which the relatively slender drilling tube 29 is suspended has to remain at its level since otherwise the drilling tube might kink. The weight of the drilling tube can, moreover, be partly taken by the tackle block, since the full weight would be too high for the desired chisel pressure.

Therefore, the upper tackle block is suspended to a carrying cable 10' of the compensated hoisting device of FIGS. 1 to 3 arranged above in the derrick 27. It is indifferent to the effect of the compensated hoisting device whether the winch 5 is arranged on the deck of the platform 28 or in the derrick 27. The gas buffer system 21 or the fluid reservoir 19 arranged in this case in the derrick may also be mounted on the deck.

FIG. 6 shows an alternative embodiment in which the tackle 7 is provided with a guide disc 30. Around the guide disc is passed a carrying cable 31, which passes along fixed guide wheels 32, 33 to a segment disc 11'. The cable is transferred to the adjacent second segment disc 14', whilst the free end of the cable is secured to a fixed point of the support. The other part of the cable is passed in a similar manner along segment discs 11'' and 14'' to a second fixed point of the support. The rotary shaft 13' of the discs is supported by a piston rod 17 of a cylinder 18'.

The hoisting cable 4 of the tackle 7 is passed directly or indirectly towards a winch disposed on the support. In this embodiment during an upward and downward movement of the support, that is to say, of the compensation device, the lower block of the tackle 7 has to be held at its level by sliding the piston rod 17 in or out. Thus the distance between the discs 11, 14 with respect to the fixed discs 32, 33 is varied so that the upper block of the tackle 7 is moved up and down. The compensation of the hoisting cable 4 in this embodiment has, however, to be taken over by the displacement of the discs 11, 14 so that the lower block of the tackle 7 remains at the same level. Nevertheless the hoisting cable can be compensated through the same or a separate system. Thanks to the double structure of the carrying cable 31 it may be thinner than in the embodiment shown in FIGS. 1 to 3 so that a more flexible system is obtained. Also in this case the segment discs may have any desired shape.

The invention is not limited to the embodiments depicted above. It is, of course, possible to double the embodiment of FIGS. 1 to 3 as well as that of FIG. 6.

What is claimed is:

1. A hoisting device arranged on a movable support, carrying cable means attached to the support, a tackle suspended from said carrying cable means and including means for attaching a load thereto, at least one hoisting cable connected with said tackle for raising and lowering a load, and motion compensating means for causing said load to remain in a fixed position when said movable support moves relative to said fixed position, said motion compensating means including a control pressure source, and pressure actuated means connected to said control pressure source said pressure actuated means being extendable and retractable in response to variation of said control pressure;

said motion compensating means also including first means and second means which are engaged by said carrying cable means and shifted by said pressure actuated means for simultaneously reeling in and paying out said carrying cable means to impart varying load-related forces on said pressure actuated means.

2. A hoisting device as defined in claim 1 including a pulley shifted by said pressure actuated means and over which said hoisting cable is passed.

3. A hoisting device as defined in claim 1 or 2 wherein said first means is a first disc cooperating with a first portion of said carrying cable means and said second means is a second disc cooperating with a second portion of said carrying cable means, at least one of said discs being eccentrically mounted on said pressure actuated means.

4. A hoisting device as defined in claim 3 wherein said discs are mounted for simultaneous rotation about a common axis with the torque exerted on one disc by said carrying cable means being opposed by the torque exerted on the other disc by said carrying cable means.

5. A hoisting device arranged on a movable support, carrying cable means attached to the support, a tackle having a first portion suspended from said carrying cable means and including a second portion having means for attaching a load thereto, at least one hoisting cable connected with said tackle for raising and lowering said second portion thereof to a desired level, and motion compensating means simultaneously for reeling in and paying out said carrying cable means to maintain the load at said level despite vertical motions of the support, said motion compensating means including a control pressure actuated means which is extendable and retractable in response to variation of said control pressure;

said motion compensating means also including means, engaged by said carrying cable means, for varying forces imparted by said carrying cable means on said control pressure actuated means in response to extension and retraction thereof.

6. A hoisting device as defined in claim 11 wherein the force varying means includes a shaft shifted by said control pressure actuated means, a first disc on said shaft to which a first portion of said carrying cable means is connected, a second disc movable about the axis of said shaft with said first disc to which a second portion of said carrying cable means is connected, said first disc together with said first portion of said carrying cable means operating to urge said shaft rotatably in one direction and said second disc together with said second portion of said carrying cable means operating to urge said shaft rotatably in an opposite direction.

7. A hoisting device as defined in claim 6 wherein said second disc is eccentrically mounted on said shaft.

8. A hoisting device as defined in claim 6 or 7 including a pulley rotatable on said shaft independently of rotation of said discs, said hoisting cable being passed over said pulley.

9. A hoisting device as defined in claim 5 wherein the force varying means includes a shaft shifted by said pressure actuated means, and including a pulley on said shaft over which said hoisting cable is passed.

10. A hoisting device for suspending a load from a floating hull subjected to vertical wave motion, comprising the combination of:

a tackle assembly comprising an upper block having at least one pulley and a lower block having at least two pulleys and provided with load supporting means;

a winch on said hull and a hoisting cable wound thereon, said hoisting cable being passed over one of said two pulleys of said lower block, over said one pulley of said upper block, over the other of said two pulleys of said lower block and then into connection with said upper block;

carrying cable means for suspending said upper block from said hull; and motion compensating means for simultaneously reeling in and paying out said carrying cable means to maintain said lower block at a substantially fixed vertical position despite vertical motion imparted to said hull, said motion compensating means comprising pressure actuated means which is expandable and retractable to reel in and pay out said carrying cable means while its actuating pressure varies in response to expansion and contraction, and means responsive to expansion and contraction of said pressure actuated means for varying the resistance to expansion and contraction thereof in consonance with variation of said actuating pressure.

11. A hoisting device as defined in claim 10 wherein the varying means includes a shaft shifted by said control pressure actuated means, a first disc on said shaft over which said carrying cable means is arranged, a second disc movable about the axis of said shaft with said first disc and over which said carrying cable means is arranged, said first disc together with said carrying cable means operating to urge said shaft rotatably in one direction and said second disc together with said carrying cable means operating to urge said shaft rotatably in an opposite direction.

12. A hoisting device as defined in claim 11 wherein said second disc is eccentrically mounted on said shaft.

13. A hoisting device as defined in claim 11 or 12 including a pulley rotatable on said shaft independently of rotation of said discs, said hoisting cable being passed over said pulley.

14. A hoisting device as defined in claim 10 wherein the varying means includes a shaft shifted by said pressure actuated means, and including a pulley on said shaft over which said hoisting cable is passed.

* * * * *